United States Patent [19]

Suzuki et al.

[11] Patent Number: 4,545,332

[45] Date of Patent: Oct. 8, 1985

[54] WATER-COOLED, FOUR-CYCLE INTERNAL COMBUSTION ENGINE FOR OUTBOARD MOTORS

[75] Inventors: Tomonori Suzuki, Hamamatsu; Makoto Toyohara, Shizuoka, both of Japan

[73] Assignee: Yamaha Hatsudoki Kabushiki Kaisha, Iwata, Japan

[21] Appl. No.: 589,227

[22] Filed: Mar. 14, 1984

[30] Foreign Application Priority Data

| | | | |
|---|---|---|---|
| Oct. 10, 1956 | [JP] | Japan | 56-142659 |
| Oct. 10, 1956 | [JP] | Japan | 56-142660 |
| Oct. 10, 1956 | [JP] | Japan | 56-142661 |
| Oct. 10, 1956 | [JP] | Japan | 56-142662 |

Related U.S. Application Data

[62] Division of Ser. No. 414,040, Sep. 2, 1982.

[51] Int. Cl.[4] ..... F01P 11/06

[52] U.S. Cl. ..... 123/41.01; 123/41.42; 123/198 E

[58] Field of Search ..... 123/41.15, 41.01, 41.42, 123/198 E; 440/88, 900; 165/134 R

[56] References Cited

FOREIGN PATENT DOCUMENTS 851650 10/1960 United Kingdom ..... 123/41.42

*Primary Examiner*—William A. Cuchlinski, Jr.
*Attorney, Agent, or Firm*—Ernest A. Beutler

[57] ABSTRACT

A compact improved four-cycle internal combustion engine of the water-cooled type for use with an outboard motor. The engine includes an exhaust arrangement wherein the exhaust gases are returned from the cylinder head to the cylinder block in proximity to a cooling jacket for cooling the exhaust gases before delivery into the lower unit. In addition, the cooling jacket and method of casting the cylinder head provides an opening in which a sacrificial anode may be placed to protect the engine from corrosion, particularly when operated in salt water. The engine is given a compact arrangement, in part, by positioning the thermostat of the cooling system in the area between the driving and slack sides of the belt that drives the overhead camshaft. The lubricating system also includes a baffled cover plate for the camshaft that receives oil flung from the camshaft and redistributes it to the valve train for lubrication.

8 Claims, 13 Drawing Figures

WATER-COOLED, FOUR-CYCLE INTERNAL COMBUSTION ENGINE FOR OUTBOARD MOTORS

This is a division of application Ser. No. 414,040, filed Sept. 2, 1982.

BACKGROUND OF THE INVENTION

This invention relates to a water-cooled, four-cycle combustion engine for outboard motors and more particularly to an improved cooling and lubricating system for such an engine.

As is well known, many outboard motors have their engines cooled by liquid from the body of water in which they operate. This water is circulated through the cylinder block and cylinder head of the engine to cool the engine. In addition, the exhaust gases are discharged downwardly through the driveshaft housing for expulsion through the lower unit. It is desirable to provide cooling for the exhaust gases before they are discharged into the lower unit so as to avoid unnecessary overheating of the driveshaft housing and lower unit. With a two-cycle engine, this is relatively easily accomplished since the exhaust gases are discharged from the cylinder block or crankcase and the engine cooling outlet is positioned in proximity to this. Thus, it is possible to provide a cooling jacket around the exhaust port of a two-cycle engine to cool the exhaust gases before discharge into the driveshaft housing and lower unit. With a four-cycle engine, however, the exhaust gases are discharged from the cylinder head and cooling of them with conventional four-cycle engines is difficult. One method which has been proposed for cooling the exhaust gases of a four-cycle outboard motor engine is to surround the exhaust manifold with a cooling jacket. This presents difficulties in that piping is required to deliver the coolant to this cooling jacket and return it to the body of water in which the motor is operated. Obviously, this also increases the cost of the engine. Another alternative is to discharge the coolant into the exhaust manifold to cool the exhaust cases. Again, plumbing is required for this. In addition, such an arrangement gives rise to the possibility that the coollant may leak back into the combustion chambers and cause severe damage to the internal components of the engine.

It is, therefore, a principal object of this invention to provide a cooling arrangement for a four-cycle water-cooled engine that permits cooling of the exhaust gases at their point of discharge.

It is another object of the invention to provide an improved liquid cooling arrangement for a four-cycle internal combustion engine that permits cooling of the exhaust gases.

It is a further object of this invention to provide a cooling jacket for the exhaust system of an internal combustion engine of the water-cooled type.

It is yet a further object of this invention to provide an improved cylinder head construction for a water-cooled four-cycle engine that permits the cooling jacket of the engine to cool the exhaust gases as they are discharged from the cylinder head.

For obvious reasons, the internal combustion engine of an outboard motor must be extremely compact. This requirement for compactness has limited the use of four-cycle engines for such applications. Because of the greater complexity of such engines, it has been difficult with conventional engines to make them compact enough to permit use as an outboard motor power plant.

It is, therefore, a further object of this invention to provide an improved cooling system for an outboard motor that permits a compact construction.

In connection with water-cooled outboard motors, a thermostat is employed so as to insure that the engine is maintained at a desirable operating temperature. If the engine is, however, of the four-cycle type, it is difficult to maintain compactness particularly for the mounting of the thermostat.

It is, therefore, a still further object of this invention to provide a thermostat location for water-cooled, four-cycle internal combustion engines in which the thermostat location is in what would be otherwise dead space of the engine.

As has been noted, the coolant for a water-cooled outboard motor is drawn from the body of water in which the motor operates. Frequently, the motors are operated in salt water which, as is well known, is extremely corrosive. This is particularly true when the castings of the engine in which the cooling jacket is formed are formed from lightweight materials or different materials that give rise to electrogalvanic action. The corrosion of the engine components can be avoided even when operating in marine environments if a sacrificial anode is placed in the engine cooling system. Again, however, the compact arrangement of the engine for an outboard motor makes it difficult to position and employ such a sacrificial anode.

It is, therefore, a still further object of this invention to provide an improved mounting arrangement for a sacrificial anode in the cooling system of an internal combustion engine.

It is another object of the invention to provide a method for mounting a sacrificial anode in an internal combustion engine wherein the anode is mounted in an opening that is provided in a wall of the engine which normally must be closed in another manner and which is used to position a mold or core during casting of the engine.

It is the normal practice with internal combustion engines for use as outboard motors to position the engine so that the crankshaft rotates about a vertically extending axis. When the engine is of the four-cycle type embodying a camshaft, this generally means that the camshaft also rotates about a vertically extending axis. With such orientations, it is difficult to insure adequate lubrication of all of the wearing components of the camshaft. Specifically, the vertical orientation of the camshaft makes it difficult to insure adequate lubrication of the cam lobes and the follower elements be they rocker arms or tappets.

It is, therefore, a still further object of this invention to provide an improved lubricating system for an engine having its camshaft rotating about a vertically extending axis.

It is a yet further object of this invention to provide an improved lubricating system for the camshaft of an internal combustion engine.

SUMMARY OF THE INVENTION

The feature of this invention is adapted to be used in an exhaust system for a water-cooled internal combustion engine having a cylinder block with a cooling jacket, a cylinder head having an exhaust port formed therein and an exhaust passage formed in said cylinder block in communication with said cylinder head exhaust port. The cylinder block cooling jacket is in heat exchanging relation at least in part to the exhaust passage.

Another feature of this invention is adapted to be embodied in a cylinder block construction for a water-cooled internal combustion engine that defines a water jacket. An exhaust passage is formed in the cylinder block and opens through a side wall thereof. A jacket plate having a projection formed therein extends at least in part into the exhaust passage and covers the opening. A closure plate is affixed to the jacket plate and forms with the projection an exhaust cooling jacket. Means communicate coolant between the water jacket and the exhaust cooling jacket.

Yet another feature of the invention is adapted to be embodied in a cylinder head for an internal combustion engine having a sealing surface adapted to be affixed in facing relationship to an associated cylinder block. Means define in part a combustion chamber in the sealing surface that is adapted to cooperate with a cylinder of an associated cylinder block. An exhaust port is formed in the cylinder head and extends from the combustion chamber and terminates in an outlet formed in the sealing surface.

Another feature of the invention is adapted to be embodied in a water cooling arrangement for an internal combustion engine intended for use as a outboard motor or the like. The motor has an output shaft that is supported for rotation about a first axis and an accessory shaft that is supported for rotation about a second axis parallel to and spaced from the first axis. First and second pulleys are fixed for rotation to the respective shafts. An endless transmitter encircles the pulleys for transmitting drive between the output shaft and the accessory shaft. A cooling jacket is provided for the engine. In accordance with the invention, the cooling jacket has a coolant opening in a wall of the engine in an area between the drive and slack sides of the flexible transmitter and a thermostat is positioned between the transmitter sides for controlling the flow through the coolant opening.

Yet another feature of the invention is adapted to be embodied in a cooling system for a water-cooled internal combustion engine that is adapted to be used for an outboard motor or the like. The engine includes a casting that forms a component of the engine and which has a cooling jacket defined at least in part by a wall. An opening is provided in the wall for supporting a core or the like for forming the cooling jacket during casting. In accordance with this feature of the invention, a sacrificial anode is supported by the wall in proximity to the opening during use of the casting as a component of the engine.

Yet another feature of the invention is adapted to be employed in a method for casting an engine component cooling jacket. In accordance with the invention, the casting is formed with an opening through which an element extends for supporting a core during casting. After the casting process, the opening is filled by means of a replaceable sacrificial anode.

Yet a further feature of the invention is adapted to be embodied in a valve train for an internal combustion engine having a camshaft supported for rotation about a generally vertically extending axis. The camshaft is enclosed and lubricant means deliver lubricant to the upper end of the camshaft. In accordance with this feature of the invention, lubricating means are provided contiguous to the camshaft for entrapping oil flung by the camshaft upon its rotation and for redirecting the entrapped oil back to the periphery of the valve train for further lubrication of it.

DETAILED DESCRIPTION OF THE PREFERRED EMBODIMENT OF THE INVENTION

Figure 1:
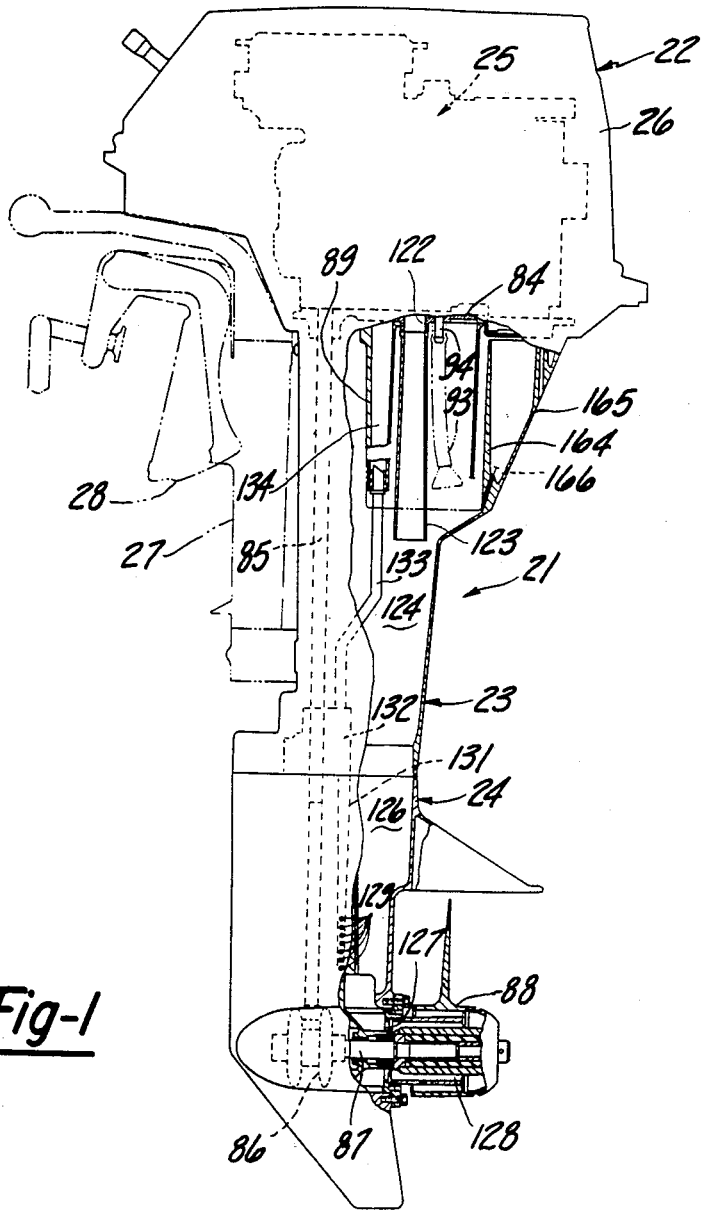
FIG. 1 is a side elevational view of an outboard motor embodying a four-cycle, water-cooled internal combustion engine constructed in accordance with the invention, with portions broken away.

Referring first to FIG. 1, an outboard motor constructed in accordance with this invention is identified generally by the reference numeral 21. The motor 21 includes a power head 22, driveshaft housing 23 and lower unit 24. The power head 22 includes a four-cycle water cooled internal combustion engine, indicated generally by the reference numeral 25 and shown in more detail in the remaining figures. A protective cowling 26 of a suitable type encircles the engine 25. The driveshaft housing portion of the engine is connected by means of a swivel bracket 27 to a transon clamp 28 so that the engine 21 may be affixed to the transom of a boat in a known manner.

Figure 2:
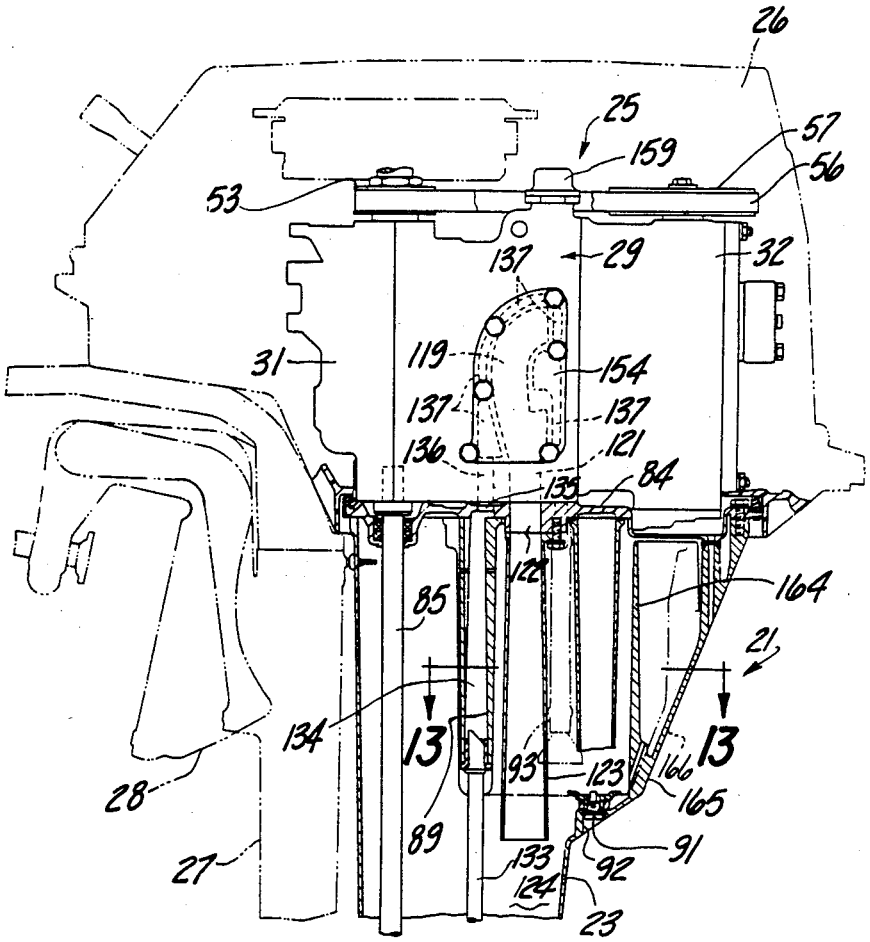
FIG. 2 is an enlarged view of the power head of the motor with the outer housing shown in phantom and portions broken away.
Figure 3:
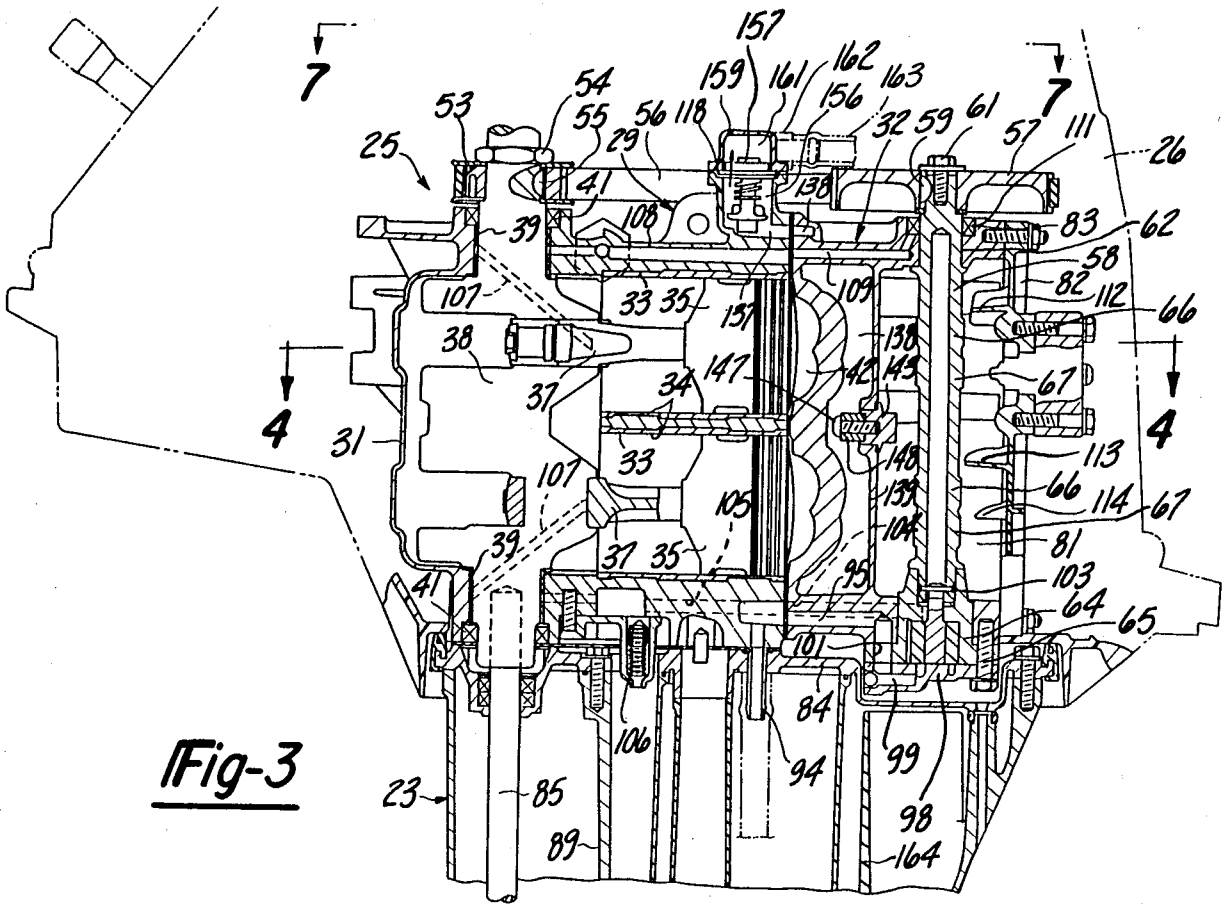
FIG. 3 is a cross-sectional view taken through the cylinder bore axis of the engine and power head.
Figure 4:
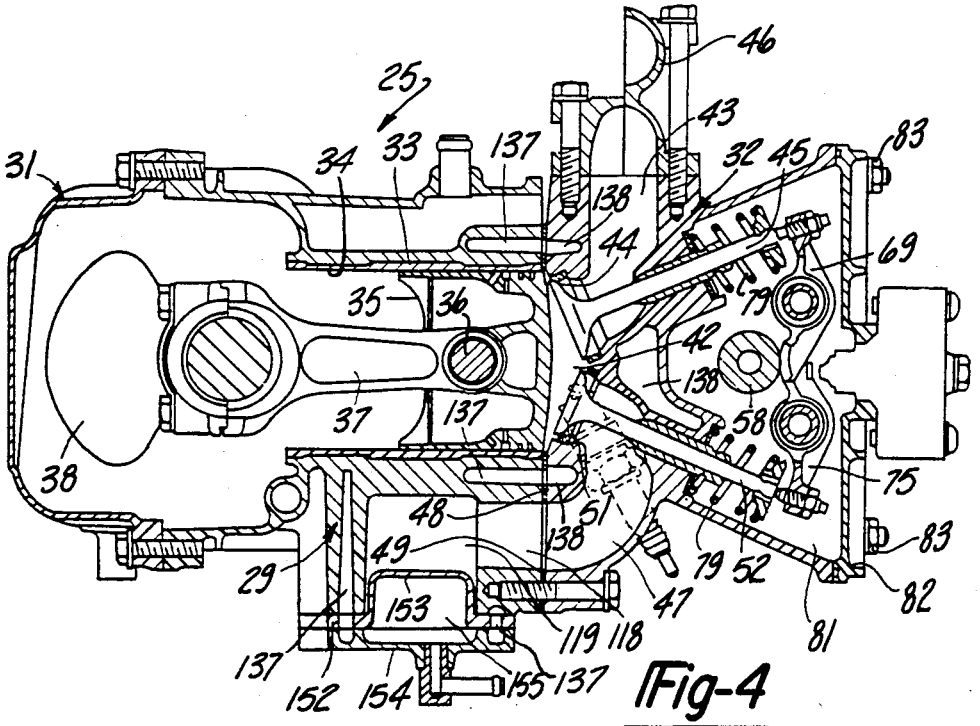
FIG. 4 is a cross-sectional view taken along the line 4—4 of FIG. 3.
Figure 8:
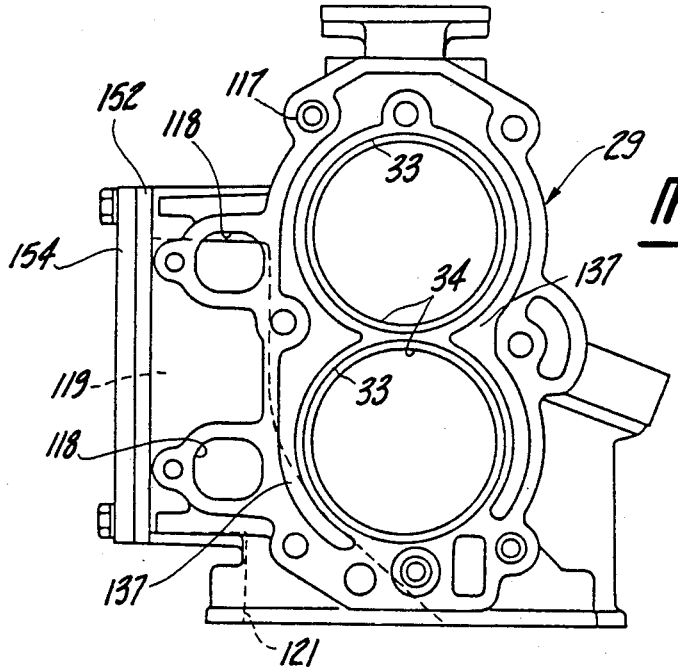
FIG. 8 is an end elevational view of the cylinder head end of the cylinder block with the cylinder head removed.

Referring now additionally to FIGS. 2 through 4, the engine 25 includes a cylinder block 29, a crankcase 31 and a cylinder head 32 that are affixed together in a known manner. The engine 25 is of the two-cylinder in-line type and accordingly the cylinder block 29 is formed with a pair of parallel cast-in cylinder liners 33 that define respective cylinder bores 34. Pistons 35 are supported for reciprocation in the cylinder bores 34. The pistons are connected, by means of piston pins 36 to one end of respective connecting rods 37. The connecting rods 37 are journalled at their opposite ends on a crankshaft 38 that is rotatably journalled between the cylinder block 29 and crankcase 31 by means of main bearings 39. Because the engine 25 is employed as an outboard motor, the axis of rotation of the crankshaft 38 extends vertically. A pair of seals 41 encircle opposite ends of the crankshaft 38 on the outboard side of the main bearings 39.

The cylinder head 32 is formed with a pair of cavities 42 each of which cooperate with the pistons 35 and cylinder bores 34 to form the combustion chambers. Intake passages 43 extend through the side of the cylinder head 32 and terminate at the respective cavities 42. A valve seat 44 is pressed into the cylinder head 32 at the termination of each intake passage 43 and an intake valve 45 cooperates with the seat 44 to control the flow of intake charge to the chambers 42. A suitable carburetor (not shown) is provided for delivering a fuel/air charge from a manifold, shown partly and identified by the reference numeral 46, to the intake passages 43.

Exhaust passages 47 extend through the opposite side of the cylinder head 32 from the cavity 42. Unlike conventional engines, the exhaust passages 47 are generally U-shaped and terminate at their outer end in a sealing surface 48 of the cylinder head 32 that is adapted to engage the head gasket 49 for a reason to be described. Valve seats 51 are formed at the inlet ends of the exhaust passages 47 and exhaust valves 52 control the flow through the exhaust passages 47.

Figure 5:
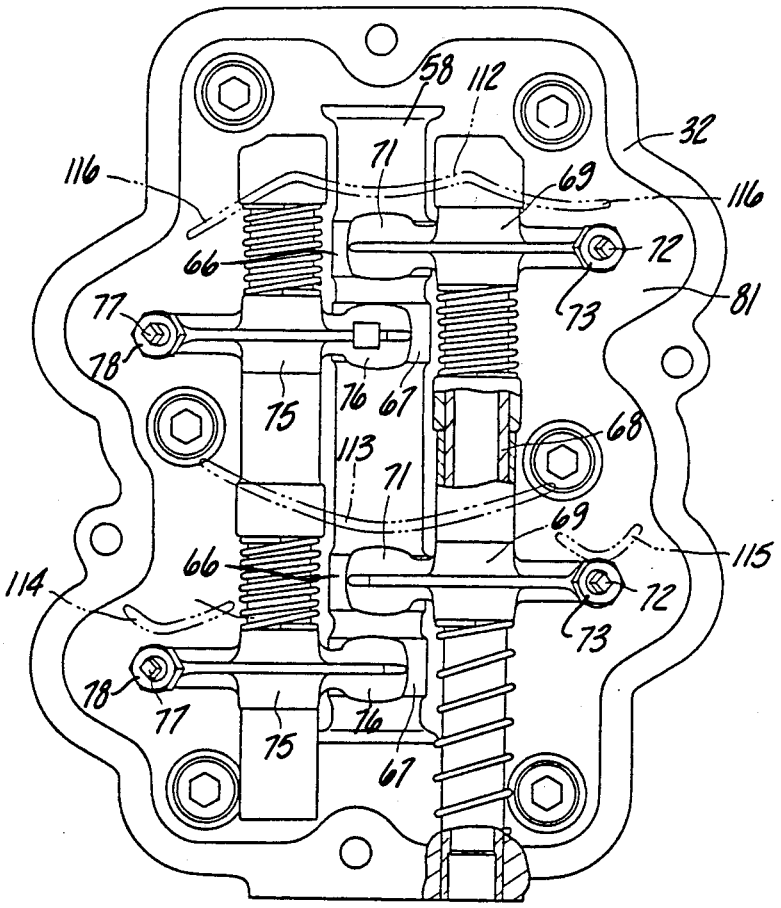
FIG. 5 is a view of the valve train of the engine with the valve cover removed and portions of the valve cover shown in phantom.
Figure 6:
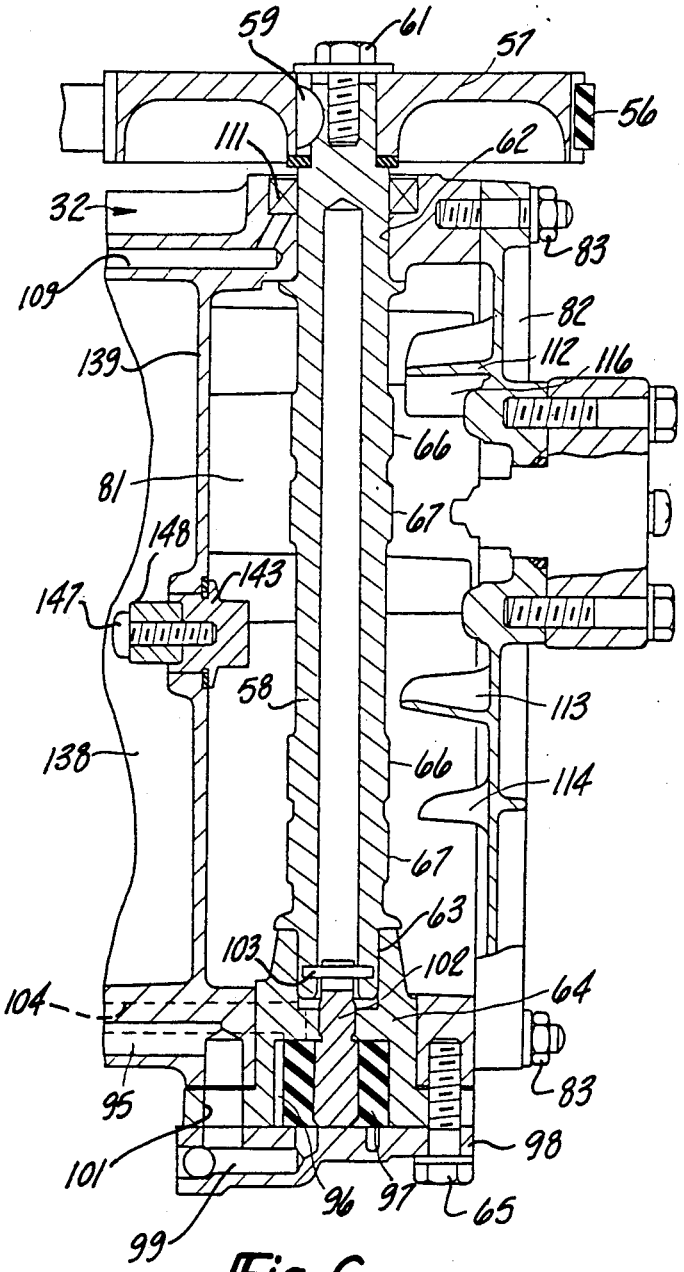
FIG. 6 is an enlarged cross-sectional view showing the camshaft and is taken the same plane as FIG. 3.
Figure 7:
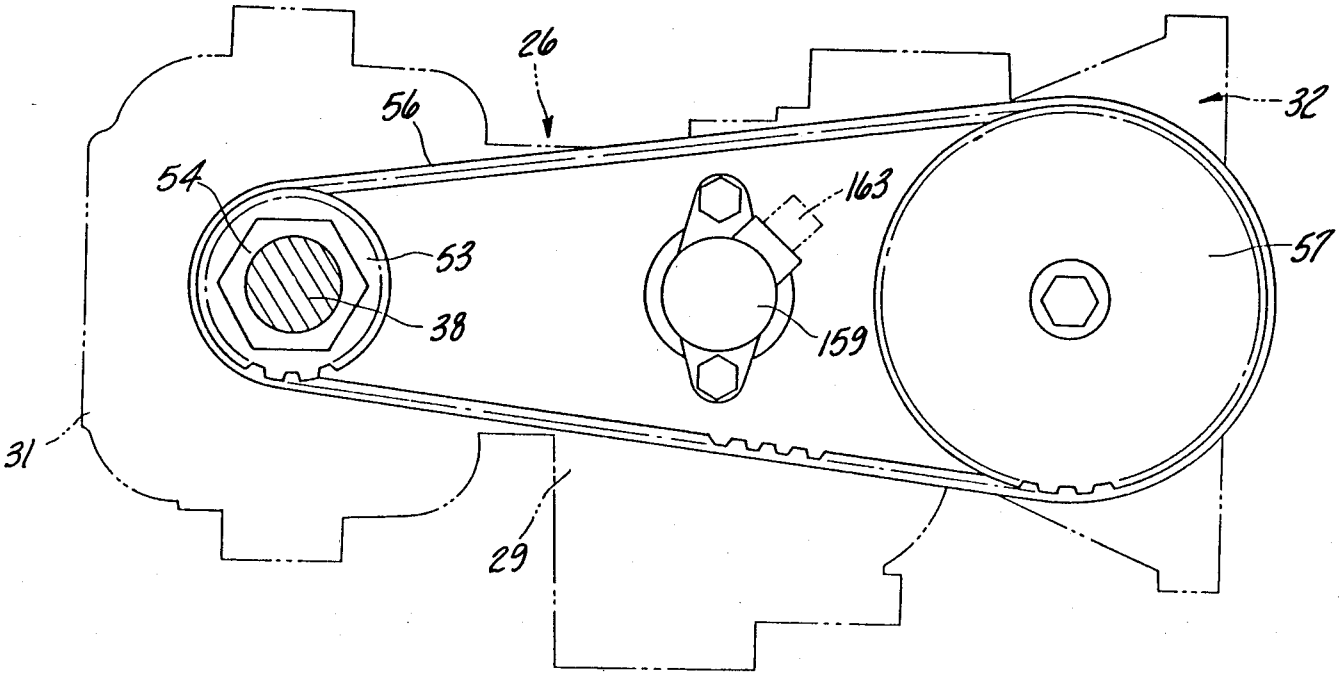
FIG. 7 is a top plan view of the engine portion of the motor taken in the direction of the line 7—7 of FIG. 3.

Referring now additionally to FIGS. 5 through 7, the mechanism for operating the valves 45 and 52 will be described. A pulley or sprocket 53 is affixed to the upper end of the crankshaft 38 in a known manner by means including a nut 54 and key and keyway 55. The pulley or sprocket 53 drives a belt or chain 56 which, in turn, drives a pulley or sprocket 57 that is affixed to the upper end of a camshaft 58 by means including a key and keyway 59 and bolt and washer 61.

The camshaft 58 has an upper bearing portion 62 that is journalled in a bore formed at the upper portion of the cylinder head 32. The lower end of the camshaft 58 is formed with a cylindrical portion 63 that is journalled in a bore of a oil pump housing 64 which is, in turn, affixed to the lower side of the cylinder head 32 by means including bolts 65. As is well known in this art, the camshaft 58 rotates about an axis that is parallel to and spaced from the axis of rotation of the crankshaft 38 and is driven at one-half of the speed of rotation of the crankshaft.

The camshaft 58 is provided with a pair of intake lobes 66 and a pair of exhaust lobes 67, there being one of each of said lobes for each cylinder. An intake rocket arm shaft 68 is supported on one side of the cylinder head 32 and journals a pair of intake rocker arms 69 each of which has a follower portion 71 that is engaged with the respective intake cam lobe 66. Adjusting screws 72 are provided at the outer ends of the rocker arms 69 and cooperate with the tips of the stems of the intake valves 45 so as to operate these valves in a known manner. The adjusting screws 72 are locked in adjusted positions by jam nuts 73.

An exhaust rocker shaft 74 is supported on the side of the cylinder head 32 opposite the intake rocker shaft 68. The exhaust rocker shaft 74 journals exhaust rocker arms 75 each of which has a follower portion 76 that is engaged with the respective exhaust cam lobe 67. The exhaust rocker arms 75 carry adjusting screws 77 at their outer ends which engage the tips of the stems of the exhaust valves 52 for operating these valves. Jam nuts 78 hold the adjusting screws 77 in their adjusted position. The rocker arms 69 and 75 function to open the intake and exhaust valves 45 and 52. Return springs 79 encircle each of the valves for urging the valves to their closed position.

The area of the cylinder head 32 that receives the camshaft 58 defines a cam cavity 81. This cavity is closed by means of a cover plate 82 that is affixed to the cylinder head 32 by means of studs and nuts 83.

Referring now primarily to FIGS. 1 through 3, the engine 25 is supported on an exhaust guide 84 that extends across the upper portion of the driveshaft housing 23. The exhaust guide 84 is, in turn, affixed to the driveshaft housing in a suitable manner. A driveshaft 85 is affixed at its upper end for rotation with the crankshaft 38 and extends downwardly through the driveshaft housing 23 and into the lower unit 24. At its lower end, the driveshaft 85 drives a forward/reverse/neutral transmission, shown in phantom in FIG. 1 and identified by the reference numeral 86, in a known manner. A propeller shaft 87 is affixed to the output shaft of the transmission 86 and drives a propeller 88 in a known manner.

Figure 13:
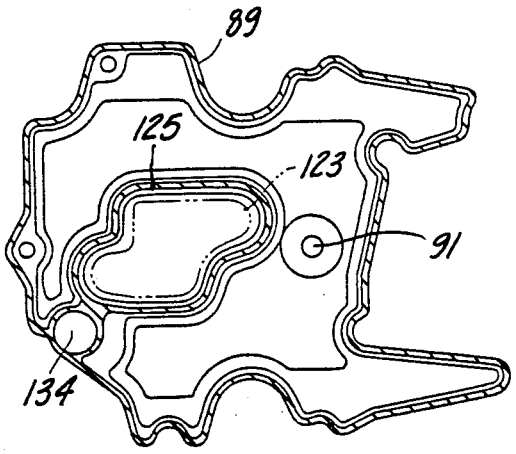
FIG. 13 is a top plan view showing the oil sump.

The engine 25 is provided with a lubricating system that includes an oil pan 89 that is affixed to and depends from the underside of the exhaust guide 84. The cross-sectional configuration of the oil pan along the plane 13—13 of FIG. 2 is shown in FIG. 13. A drain plug 91 is provided in a lower wall of the oil pan 89 and is accessible through an opening 92 in the driveshaft housing 23 so as to permit draining of the oil from the oil pan 89.

An oil delivery tube 93 depends into the oil pan 89 from an oil inlet nipple 94 that is pressed into the cylinder block 29 and which extends through a suitable aperture in the exhaust guide 84. The nipple 94 delivers oil to an oil pump inlet passage 95 that is formed in the cylinder block 29 and cylinder head 32.

The oil pump of the engine may be best seen in FIGS. 3 and 6. As has been noted, the lower camshaft end 63 is rotatably journalled in an oil pump housing 64 which is, in turn, affixed to the cylinder head 32. The oil pump housing 64 defines a pumping cavity 96 in which a pumping element 97 is positioned. The lower end of the pumping cavity 96 is closed by an oil pump cover plate 98 which is held to the oil pump housing 64 by the bolts 65 which also affix the oil pump housing 64 to the cylinder head 32. The oil pump end plate 95 has an oil delivery passage 99 that mates with an oil delivery passage 101 in the pump housing 64. The delivery passage 101 mates with the cylinder head inlet passage 95 so that oil will be delivered from the sump 89 into the pumping cavity 96.

The pumping element 97 is driven by a pump drive shaft 102 that is keyed, as by a pin 103, to the camshaft end 63. Hence, upon rotation of the camshaft 58, oil will be drawn from the sump 89 through the various passageways and pressurized by the pumping element 97. The pressurized oil is delivered to the engine through an oil pressure passage 104 that is formed in the pump housing 64 and cylinder head 32. The cylinder head oil pressure passage 104 extends in part to the camshaft bearing portion 63 and mates with a cylinder block oil pressure passage 105 (FIG. 3) which serves the function of delivering the oil to the crankshaft 38 for lubricating the main bearings 39.

A pressure relief valve 106 is positioned in registry with the passage 105 so that the oil pressure in the lubrication system may be regulated. The crankshaft 38 is provided with cross drillings 107 so that oil delivered under pressure through the conduit 105 may be used to lubricate the bearings 39 and the bearings on the connecting rod journals (not shown). A further oil delivery passage 108 extends from the area of the upper main bearing 39 through the cylinder block 29 and to an oil passage 109 formed in the cylinder head 32. The oil passage 109 terminates at a seal 111 that surrounds the upper end of the camshaft bearing portion 62. Hence, oil under pressure is delivered to the outer periphery of the camshaft 58 so that it may flow by gravity down the camshaft 58 to lubricate its various bearing surfaces.

As may be best seen in FIGS. 3, 5 and 6, the vertical orientation of the camshaft 58 causes the oil to be delivered downwardly along this shaft and lubricate the various surfaces. However, rotation of the camshaft 58 will tend to sling the oil from the shaft 58 outwardly. In order to entrap this slung oil and return it to the camshaft 58 in areas where the valve train is to be lubricated, the camshaft cover 82 is provided with a plurality of oil entrapment and return devices indicated generally by the reference numerals 112, 113 114 and 115. The devices 112, 113, 114 and 115 are generally configured so as to capture oil that is thrown outwardly from the camshaft 53 and return it to either the camshaft or other components of the valve train to be lubricated.

The manner in which this is done may be best understood by reference to FIG. 5 wherein the devices 112, 113, 114 and 115 are shown in phantom since this view is taken with the cover plate 82 removed. The first device 112 has a generally arcuate center section that is disposed immediately above the cam lobe 66. Oil will tend to accumulate in this area and be thrown outwardly due to the shoulder formed by the lobe 66. Some of this oil which is trapped by the device 112 will be returned directly to the camshaft in the area of the lobes 66 and 67. The remainder of the oil will be delivered by downwardly extending projections 116 to the outer ends of the rocker arms 69 and 75 so as to lubricate the adjusting screws 72 and 77 and their contact with the upper ends of the respective valve stems.

The device 113 has a generally trough shape and is juxtaposed to the upper side of the lower cam lobe 66. Again, oil will be thrown outwardly and accumulated by the shape of the device 113. A portion of this oil will be delivered directly to the cam lobes 66 and 67 so as to lubricate these lobes and the rocker arm follower portions 71 and 77. In addition, oil will flow off of the outer ends of the device 113 to be delivered to the devices 114 and 115. These devices are in proximity to the outer ends of the rocker arms 69 and 75, respectively. Hence, the outer ends of the rocker arms and specifically the point of contact between the adjusting screws 72 and 77 and the respective valves will be lubricated. Thus, it should be readily apparent that this system insures good usage of the oil and does not require the provision of extensive oil passageways in the camshaft. Thus, the vertical orientation of the camshaft and the uses of the devices 112, 113, 114 and 115 insures good lubrication and permits the engine to be manufactured at a relatively low cost. The device for accumulating and redirecting the oil may, of course, be formed on the cylinder head 32.

The exhaust system of the engine will now be described primarily in relation to FIGS. 1, 2, 4, 8 and 10. As has been noted, conventional four-cycle, water-cooled engines have their exhaust passages extending outwardly through the side of the cylinder heat so that the exhaust gases are discharged away from the cylinder block. However, in conjunction with outboard motor applications, it is desirable to provide some cooling of the exhaust gases before they are discharged into the drive shaft housing 23. With conventional cylinder head exhaust gas porting, this has necessitated additional plumbing of the coolant from the cooling jacket so as to deliver it to the exhaust system. In accordance with this invention, however, the exhaust gases are routed from the cylinder head into the cylinder block in proximity to its cooling jacket so that the exhaust gases can be cooled down before delivery into the drive shaft housing 23.

It has been noted that the cylinder head exhaust gas ports 47 have a generally U shape. As a result of this, the exhaust gas ports 47 of the cylinder head terminate in its lower sealing surface 48 as is clearly shown in FIG. 10 which is a view of the underside of the cylinder head 32. The cylinder block 29 has in its mating sealing surface 117 (FIG. 8) a pair of exhaust gas collector passages 118. The exhaust gases are therefore delivered from the cylinder head exhaust gas ports 47 to the cylinder block exhaust gas collector passages 118. The passages 118 of the cylinder block merge into an enlarged collecting chamber 119 that has a passage discharge 121 that extends downwardly through the cylinder block 29 and which registers with an exhaust gas passage 122 of the exhaust guide 84. An exhaust pipe 123 extends downwardly through a complementary opening formed in the oil pan 89 for discharge of the exhaust gases into an expansion chamber 124 of the drive shaft housing 23. This clearance in the oil pan 89 is provided by an upstanding wall 125 which surrounds the exhaust pipe 123 as may be best seen in FIG. 13.

The exhaust gases flow from the drive shaft housing expansion chamber 124 to a corresponding chamber 126 formed in the lower unit 24. The exhaust gases my then pass outwardly through exhaust gas discharges 127 in rear wall of the lower unit 24 for discharge through axial extending passageways 128 of the propeller 88.

Figure 9:
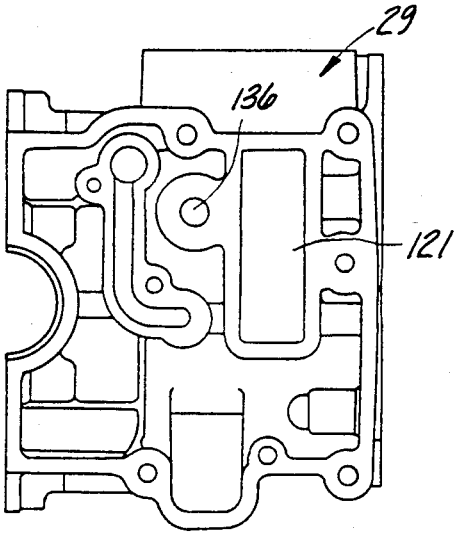
FIG. 9 is a bottom plan view of the cylinder block.
Figure 10:
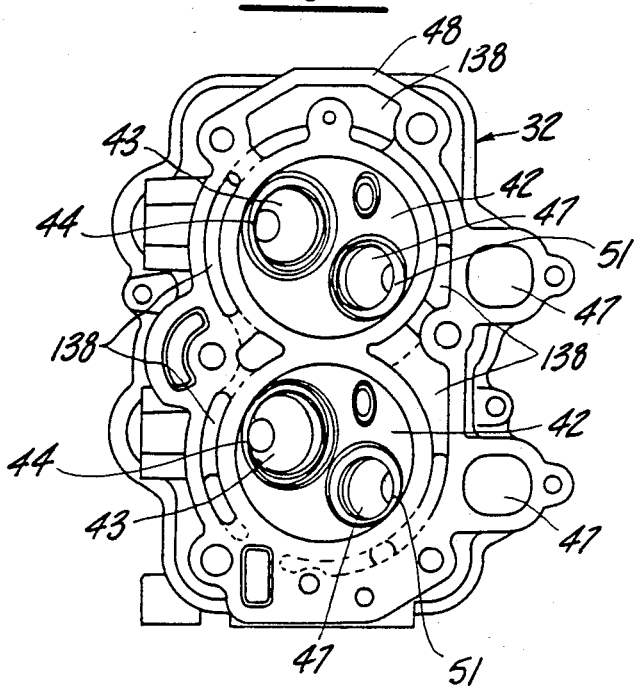
FIG. 10 is a side elevational view of the surface of the cylinder head that mates with the cylinder block.

The cooling system for the engine 25 will now be described by principal reference to all figures of the drawings except for FIGS. 5 and 13. Referring first to FIG. 1, the opposite sides of the lower unit 24 are provided with a plurality of vertical spaced water inlets 129 that permit water to be drawn from the body in which the motor 21 is operating. These water inlets 129 supply a delivery pipe 131 from which, in turn, water is drawn by a coolant pump assembly 132 that is driven from the drive shaft 85 at an intermediate location and particularly at the area where the drive shaft housing 23 joins the lower unit 24. The coolant pump 132 discharges through a coolant delivery passage 133 which in turn discharges into a generally vertically extending coolant chamber 134 formed in the oil sump 89 in proximity to the lubricant therein. The coolant flows upwardly from the area 134 through a water delivery opening 135 formed in the exhaust guide 84 (FIG. 2) for delivery to a cylinder block coolant inlet 136 (FIGS. 2 and 9).

The cylinder block coolant inlet 136 serves the cylinder block cooling jacket which is of a suitable configuration and which has been identified by the reference numeral 137. The cylinder block cooling jacket 137 surrounds the cylinders 33 and serves to cool them in a known manner. In addition, coolant is delivered from the cylinder block cooling jacket 137 to a cylinder head cooling jacket, which has been indicated by the reference numeral 138. The cylinder head cooling jacket 138 encircles primarily the cavities 42 for cooling the combustion chambers.

Figure 11:
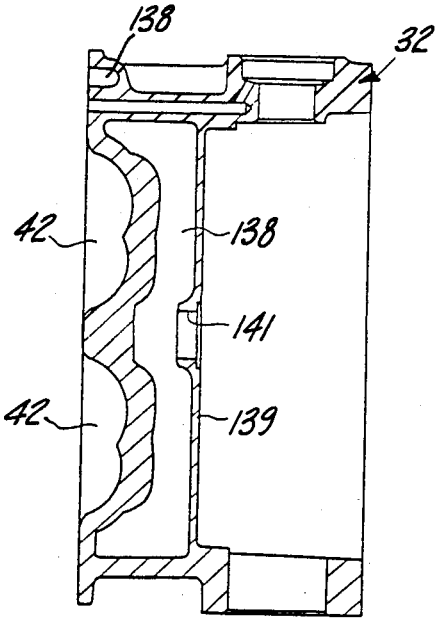
FIG. 11 is a cross-sectional view taken through the cylinder head in the as cast condition.

The cylinder head cooling jacket 138 is separated from the camshaft chamber 81 by means of a wall, indicated generally by the reference numeral 139. When the cylinder head 32 is cast, it is the normal practice to position a core or mold in the outer mold so as to define the cooling jacket 138. This core or mold is normally held in position in a suitable manner by a device that extends through an opening 141 in the area where the wall 139 will be formed. This construction is shown in FIG. 11 that illustrates generally the cylinder head 32 in its as cast position. Normally once the casting process is completed and the core removed, the opening 141 is closed by means of a freeze plug or similar device. In accordance with this invention, however, the opening 141 is employed to support a sacrificial anode so as to reduce corrosion of the castings of the engine. The sacrificial anode is particularly useful when the outboard motor 21 is operated in salt water.

Figure 12:
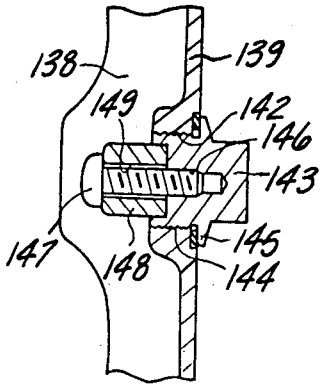
FIG. 12 is an enlarged cross-sectional view showing a portion of the cylinder head and the sacrificial anode.

Referring now primarily to FIGS. 3, 6 and 12, after the casting of the cylinder head 32 is completed and the core is removed through the opening 141, the opening 141 is tapped as at 142. A closure plug 143 is provided with a male threaded portion 144 that is received within the threaded opening 142 to affix the closure plug 143 in position. A gasket 145 is positioned between a shoulder on the closure plug 143 and the wall 139 so as to prevent leakage.

The underside of the closure plug is formed with a tapped opening 146 that receives a screw 147. An annular sacrificial anode 148 having a central opening 149 is affixed to the closure plug 143 by the screw 147 and extends into the cooling jacket 138. The sacrificial anode 148 is formed from a material that is high on the electrochemical scale so that any electrogalvanic action will tend to consume the anode 138 rather than the less active material from which the cylinder block 29 and/or cylinder head 42 are formed. Also, the anode 148 may be readily replaced by removal of the plug 143 and the screw 147.

As has been noted, it is desirable to cool the exhaust gases before they are delivered into the drive shaft housing 23 and lower unit 24. The structure that achieves this result may be best understood by reference to FIGS. 2, 4 and 8. The cylinder block exhaust collector portion 119 opens through an outer wall of a projection 151 formed at the outer side of the cylinder block 29. A jacket plate 152 having a cup shaped portion 153 is affixed to the outer side of the projection 151 and encloses the opening in the side of the collector portion 119. A cover plate 154 extends on the outer side of the jacket plate 153 and thus forms a coolant jacket 155 that extends a substantial distance along the collector portion 119. The jacket 155 is in fluid communication with the cylinder block cooling jacket 137 in a suitable manner. Thus, coolant that is circulates through the jacket 155 will serve to cool the exhaust gases discharged from the respective cylinders 34 before their admission to the exhaust guide 84 and exhaust pipe 123. This cooling will prevent overheating of the drive shaft housing 23 and lower unit 24.

Coolant is delivered from the cylinder block cooling jacket 137 and cylinder head cooling jacket 138 to a well 156 (FIG. 3) formed in a projecting portion of the upper surface of the cylinder block 29 in the area between the driving and slack sides of the belt or transmitter 56. A thermostat 157 is positioned within the well 156 with its outer flange 158 clamped between the upper surface of the cylinder block projection and a thermostat housing 159 that is fixed in a suitable manner to the cylinder block between the driving and slack sides of the belt 56. The thermostat 157 will open and close to maintain a uniform temperature in the cooling jackets 138 and 139 and water will be discharged when the thermostat 157 is opened to a chamber 161 formed in the thermostat housing 159 above the thermostat 158. This cooling water is discharged through a nipple 162 to a coolant return conduit shown in phantom and identified by the reference numeral 163.

The conduit 163 delivers the coolant to a well formed in the upper part of the driveshaft housing 23 by a vertically extending wall 164 and the rear surface 165 of the upper portion of the drive shaft housing 23. Coolant is discharged from this wall outwardly of the engine through one or more discharge ports 166 formed in the rear surface 165.

It should be readily apparent that the described engine construction permits an extremely compact four-cycle, water-cooled internal combustion engine that can be used as an outboard motor. Because of the construction of the engine, the cylinder head and cylinder block cooperate with the cooling jacket to permit cooling of the exhaust gases before discharge into the exhaust pipe. The cooling system also includes an extremely compact arrangement wherein the thermostat housing is located in an otherwise void area between the driving and slack sides of the timing belt. The cylinder head is cast in such a way that an opening which supports the core for forming the water jacket may also be used to support a sacrificial anode to protect the cooling jacket from corrosion, particularly when the engine is used in marine environments. In addition, the lubricating system employs an improved and simplified manner for lubricating the vertically disposed camshaft of the engine, particularly in all of the high wear areas. Although the invention has been described in conjunction with a two-cylinder engine, it is to be understood that it may be used in conjunction with engines having other cylinder numbers or cylinder types. In addition, even though the exhaust system disclosed delivers the exhaust gases through the propeller, it obviously can be used with other types of exhaust systems. The cooling of the exhaust gases prior to their discharge into the exhaust pipe is done in such a way as to insure against the likelihood of coolant passing back into the engine cylinders through the exhaust system.

Although certain embodiments of the invention have been described, it is believed obvious that other modifications and variations will present themselves to those skilled in the art without departing from the spirit and scope of the invention, as defined by the appended claims.

We claim:

1. In a cooling system for a water-cooled internal combustion engine for an outboard motor or the like comprising a casting forming a component of the engine, said casting having a cooling jacket defined at least in part by a wall thereof, and an opening in said wall for supporting a core or the like for forming said cooling jacket during casting, the improvement comprising a sacrificial anode supported by said wall in proximity to said opening during use of said casting as a component of the engine.

2. A cooling system as set forth in claim 1 wherein the sacrificial anode is removable through the opening from the cooling jacket.

3. In a cooling system as set forth in claim 1 wherein the sacrificial anode is supported by a member that forms a closure for the opening in the wall.

4. In a cooling system as set forth in claim 3 wherein the sacrificial anode is removable from the cooling jacket by the closure member through the opening in the wall.

5. In a cooling system as set forth in claim 3 wherein the supporting member comprises a male threaded plug received in a female threaded opening in the wall, the sacrificial anode being supported at the end of said plug in the cooling jacket.

6. In a cooling system as set forth in claim 5 wherein the sacrificial anode is removable with the plug from the cooling jacket through the opening.

7. In a cooling system as set forth in claim 5 wherein the sacrificial anode is removably supported by the plug.

8. In a cooling system as set forth in claim 7 wherein the sacrificial anode is removable with the plug from the cooling jacket through the opening.

* * * * *